US007986898B2

(12) United States Patent
Hashimoto

(10) Patent No.: US 7,986,898 B2
(45) Date of Patent: Jul. 26, 2011

(54) IMAGE FORMING APPARATUS WITH CONTACTS FOR MEMORY CHIPS

(75) Inventor: Junichi Hashimoto, Toyohashi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 165 days.

(21) Appl. No.: 12/408,747

(22) Filed: Mar. 23, 2009

(65) Prior Publication Data

US 2009/0269097 A1 Oct. 29, 2009

(30) Foreign Application Priority Data

Apr. 23, 2008 (JP) ..... 2008-112678

(51) Int. Cl.
*G03G 15/00* (2006.01)

(52) U.S. Cl. ..... 399/90; 399/107; 399/113; 399/228

(58) Field of Classification Search ..... 399/90, 399/107, 113, 228
See application file for complete search history.

(56) References Cited

U.S. PATENT DOCUMENTS

| | | | |
|---|---|---|---|
| 6,493,519 | B2 | 12/2002 | Sasame et al. |
| 6,751,428 | B2 | 6/2004 | Okabe |
| 2003/0091361 | A1 | 5/2003 | Noda et al. |
| 2007/0141889 | A1* | 6/2007 | Chadani et al. ..... 439/357 |
| 2007/0183814 | A1 | 8/2007 | Kamimura |

FOREIGN PATENT DOCUMENTS

| | | |
|---|---|---|
| JP | 62-209468 | 9/1987 |
| JP | 2001-215862 | 8/2001 |
| JP | 2003-084647 | 3/2003 |
| JP | 2003-177650 | 6/2003 |
| JP | 2003-228207 | 8/2003 |
| JP | 2006-126258 | 5/2006 |
| JP | 2007-017774 | 1/2007 |
| JP | 2007-178654 | 7/2007 |

OTHER PUBLICATIONS

Notification of Reason for Refusal for Japanese Application No. 2008-112678 mailed Feb. 2, 2010.

* cited by examiner

*Primary Examiner* — Ryan D Walsh
(74) *Attorney, Agent, or Firm* — Banner & Witcoff, Ltd.

(57) ABSTRACT

An image forming apparatus is provided. The image forming apparatus includes: plural photosensitive members aligned in a first direction; plural developing units for the photosensitive members, respectively, each of the developing units including a developer supplier, and a housing which holds the developer supplier; a translation member which moves the developing units between a contact position in which the developer suppliers contact the photosensitive members and a separated position in which the developer suppliers are separated from the photosensitive members by a linear reciprocating movement in the first direction; plural memory chips provided on the housings of the developing units, respectively; plural contacts provided on the translation member, each of the contacts configured to contact the corresponding memory chips; and a wiring provided on the translation member and electrically connected to each of the contacts.

8 Claims, 5 Drawing Sheets

IMAGE FORMING APPARATUS WITH CONTACTS FOR MEMORY CHIPS

CROSS-REFERENCE TO RELATED APPLICATION

This application claims priority from Japanese Patent Application No. 2008-112678, filed on Apr. 23, 2008, the entire subject matter of which is incorporated herein by reference.

TECHNICAL FIELD

Aspects of the present invention relate to an image forming apparatus such as a color printer.

BACKGROUND

In a related-art image forming apparatus such a color printer, a tandem-type image forming apparatus includes photosensitive drums disposed in parallel for colors of yellow, magenta, cyan and black.

In the tandem-type image forming apparatus, developing rollers are provided for photosensitive drums, respectively. By rotating the photosensitive drums and the developing rollers in such a state that the developing rollers are in contact with the photosensitive drums, toner is supplied from the developing rollers to form electrostatic latent images on the photosensitive drums, whereby toner images are carried on the photosensitive drums. A color image forming is performed on a sheet by forming color toner images on the photosensitive drums, respectively, and transferring the color toner images of the respective colors onto the sheet in an overlapping manner. A monochrome image forming is performed on a sheet by forming a black toner image only on the photosensitive drum for black, and transferring the black toner image onto the sheet.

As such a tandem-type image forming apparatus, JP-A-2007-178654 describes an image forming apparatus which includes a translation cam member which is movable along a straight line in a direction in which photosensitive drums are arranged. The translation cam member is provided for switching a state among a total separated state in which all the developing rollers are separated from the photosensitive drums, a black contact state in which the developing roller contacts the photosensitive drum for black while the other developing rollers are separated from the photosensitive drums for yellow, magenta and cyan, and a total contact state in which all the developing rollers contact all the photosensitive drums, respectively.

Additionally, in an image forming apparatus, each of developing cartridges which hold developing rollers is provided with a memory chip for storing information related to the developing cartridge.

SUMMARY

In such a tandem-type image forming apparatus as described above, it is conceivable that each of the developing cartridge is provided with a memory chip for storing the amount of residual toner in the developing cartridge to notify a replacement timing of the developing cartridge.

In order to attain the reading and writing (communication) of information from and to the memory chip, contacts to be connected to the memory chips have to be arranged within the apparatus main body. However, there has to be provided the translation cams and mechanisms for inputting driving force into the developing cartridges in the periphery of the developing cartridges. Accordingly, no sufficient space exists for arranging the contacts in the periphery of the developing cartridges. Therefore, it is difficult to arrange the contacts in the periphery of the developing cartridges. On the other hand, if ensuring a space for arranging the contacts, the size of the image forming apparatus is increased by an amount of such space.

Accordingly, it is an aspect of the present invention to provide an image forming apparatus which can avoid an increase in size of the image forming apparatus while providing contacts for memory chips for communication.

According to an exemplary embodiment of the present invention, there is provided an image forming apparatus comprising: a plurality of photosensitive members which are arranged in parallel with each other and aligned in a first direction; a plurality of developing units which are provided correspondingly to the photosensitive members, respectively, and which arranged in parallel with each other and aligned in the first direction, each of the developing units comprising a developer supplier configured to supply developer to the corresponding photosensitive member, and a housing which holds the developer supplier; a translation member which opposes all the developing units from a side thereof in a second direction orthogonal to the first direction, and which moves the developing units between a contact position in which each of the developer suppliers contacts the corresponding photosensitive member and a separated position in which each of the developer suppliers is separated from the corresponding photosensitive member by a linear reciprocating movement of the translation member in the first direction; a plurality of memory chips provided on the housings of the developing units, respectively, at portions which oppose the translation member; a plurality of contacts provided on the translation member correspondingly to the plurality of memory chips, each of the contacts configured to contact the corresponding memory chips; and a wiring provided on the translation member and electrically connected to each of the contacts.

DETAILED DESCRIPTION

1. Configuration (1) Overall Configuration

Figure 1:
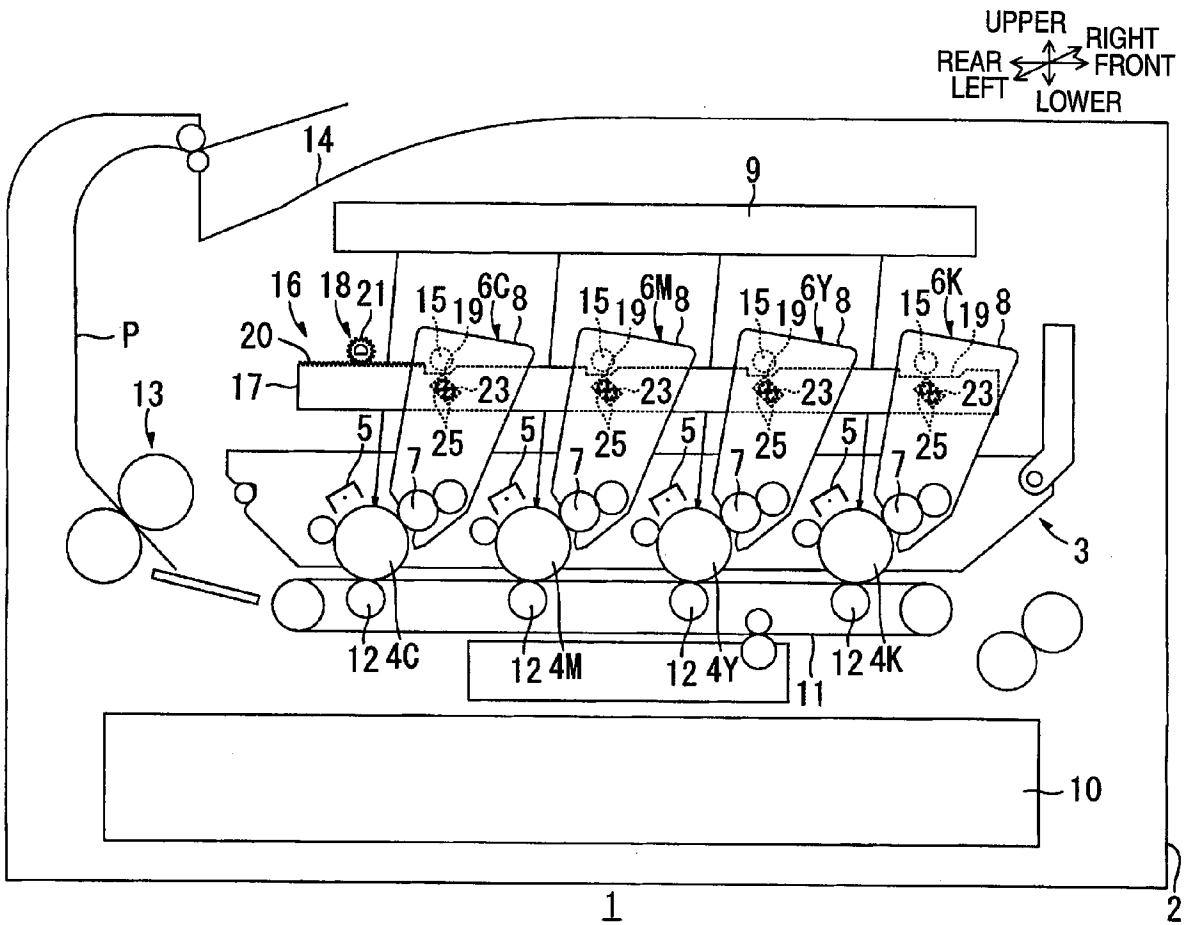
FIG. 1 is a side sectional view of a color printer according to an exemplary embodiment of the invention in an all contact state in which all developing cartridges are disposed in contact positions.
Figure 2:
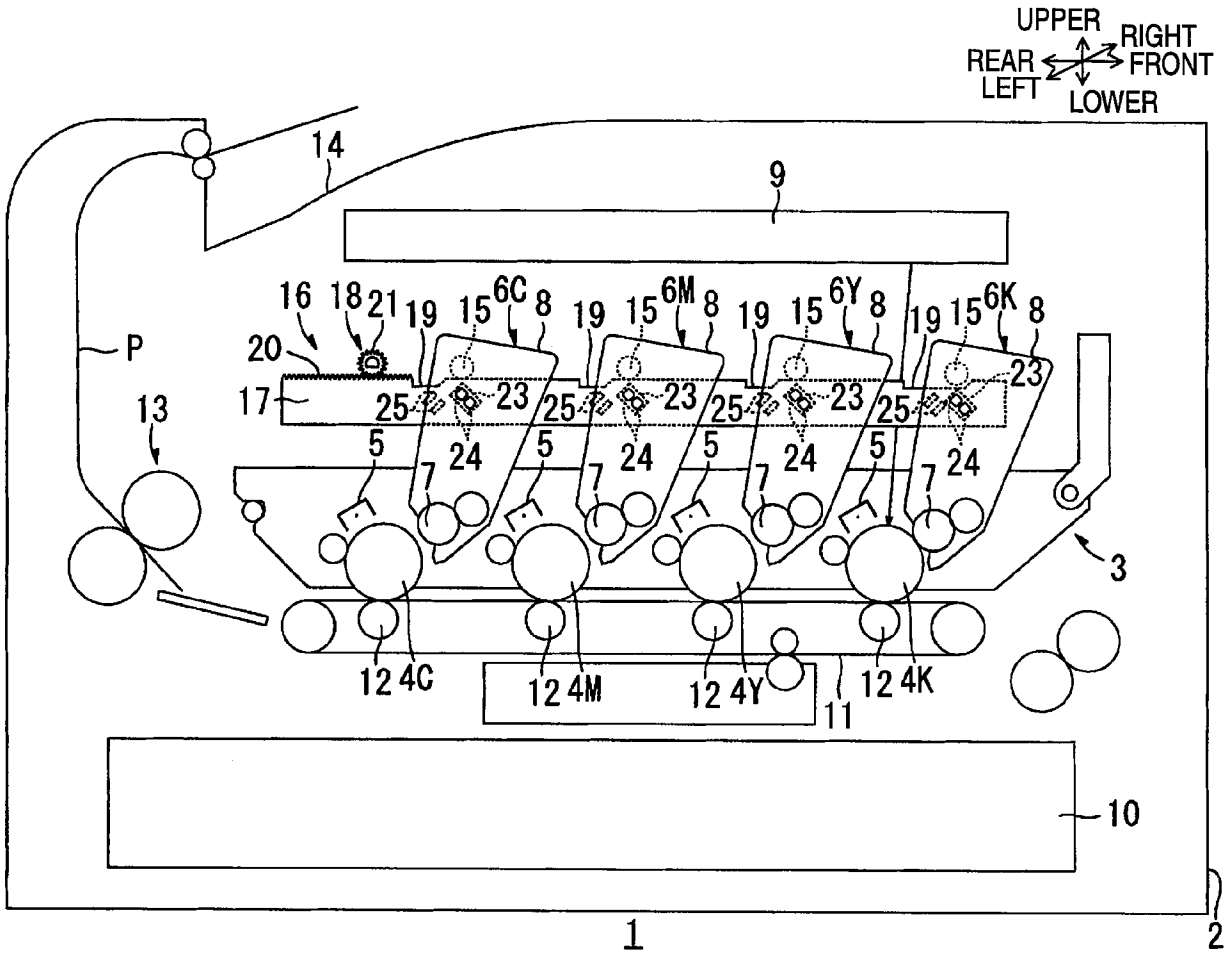
FIG. 2 shows the color printer of FIG. 1 in a black contact state in which the developing cartridge for black is disposed in the contact position, while the other developing cartridges are disposed in separated position.
Figure 3:
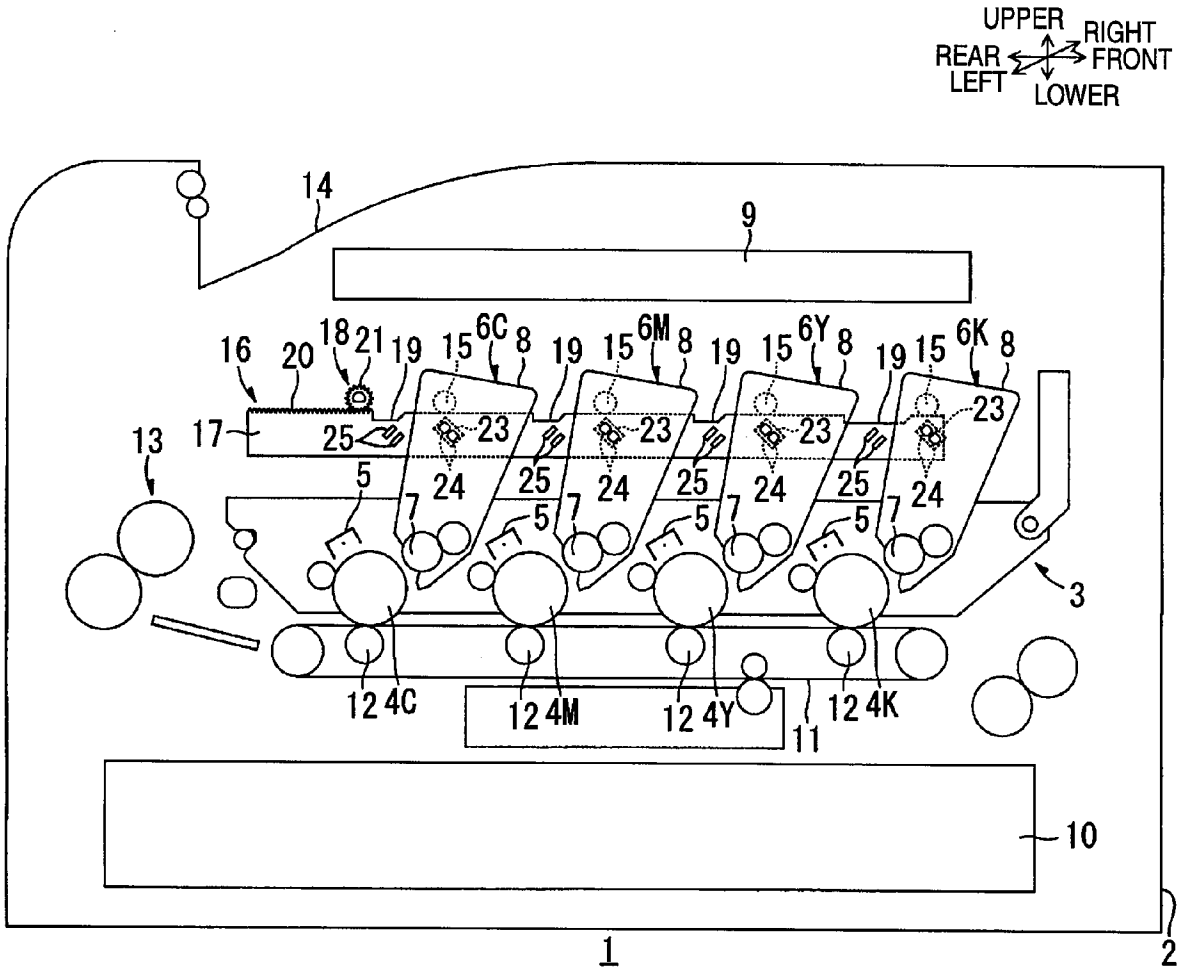
FIG. 3 shows the color printer of FIG. 1 in an all separated state in which all the developing cartridges are disposed in the spaced positions.

FIGS. 1 to 3 are side sectional views of a color printer as an example of an image forming apparatus according to an exemplary embodiment of the present invention. FIG. 1 shows an all contact state in which all developing cartridges as an example of a developing unit are disposed in contact positions. FIG. 2 shows a black contact state in which the developing cartridge for black is disposed in the contact position while the other developing cartridges are disposed in separated positions. FIG. 3 shows an all separated state in which all the developing cartridges are disposed in the separated positions.

A color printer 1 is a tandem-type color printer. A drum unit 3 is mounted in a body casing 2. This drum unit 3 is removably mounted in the body casing 2 by opening a cover provided on one side of the body casing 2.

Four photosensitive drums 4, which are an example of a photosensitive member, are provided in the drum unit 3. The four photosensitive drums 4 are provided to correspond to four colors of black, yellow, magenta and cyan and are arranged in parallel with each other and aligned at equal intervals in that color order along a conveyance direction in which a sheet P is conveyed by a conveyance belt 11, which will be described later.

Scorotron-type chargers 5 and developing cartridges 6 are provided in the drum unit 3 correspondingly to the photosensitive drums 4. The developing cartridges 6 are arranged in parallel with each other and aligned in the conveyance direction. Each of the developing cartridges 6 includes a developing roller 7 as an example of a developer supplier for supplying toner (developer) to the corresponding photosensitive drum 4, and a housing 8 which has a box shape for accommodating toner in an interior thereof and holds the developing roller 7 at a lower end portion. So that a part of the circumferential surface of the developing roller 7 is exposed therefrom. The developing cartridges 6 are removably mounted in the drum unit 3.

An exposing unit 9 for emitting four laser beams corresponding to the four colors is disposed above the drum unit 3.

As the photosensitive drums 4 rotate, the surfaces of the photosensitive drums 4 are uniformly charged by the scorotron-type chargers 5 and thereafter are exposed selectively by laser beams from the exposing unit 9. This exposure selectively removes electric charges from the surfaces of the photosensitive drums 4, whereby electrostatic latent images are formed on the surfaces of the photosensitive drums 4. By this series of operations, toner images are formed on the surfaces of the photosensitive drums 4.

It is noted that in place of the exposing unit 9, four LED arrays may be provided correspondingly to the photosensitive drums 4.

A sheet feeding cassette 10 for accommodating sheets P is disposed at a bottom portion of the body casing 2. The sheets P accommodated in the sheet feeding cassette 10 are fed out therefrom to be conveyed on the conveyance belt 11 by various types of rollers. The conveyance belt 11 is disposed to oppose the four photosensitive drums 4 from therebelow. Transfer rollers 12 are disposed in positions which oppose the photosensitive drums 4 respectively across an upper portion of the conveyance belt 11. A sheet P conveyed on the conveyance belt 11 passes sequentially between the conveyance belt 11 and the photosensitive drums 4 as the conveyance belt 11 is rotated. When the sheet P faces the toner images formed on the surfaces of the photosensitive drums 4, the toner images are transferred onto the sheet P by transfer bias applied to the transfer rollers 12.

A fixing unit 13 is provided downstream of the conveyance belt 11 in the conveyance direction of the sheet P. The sheet P onto which the toner images have been transferred is conveyed to the fixing unit 13. In the fixing unit 13, the toner images are fixed to the sheet P by heating and pressing. The sheet P to which the toner images have been fixed is then discharged onto a sheet discharging tray 14 on an upper surface of the body casing 2 by various types of rollers.

It is noted that in the drawings, K (black), Y (yellow), M (magenta), and C (cyan) which denotes the respective colors are given to the ends of the reference numerals for the photosensitive drums 4 and the developing cartridges 6. In the following description, when attempting to distinguish the photosensitive drums 4 and the developing cartridges 6 of specific colors from that of the other colors, the reference numerals having K, Y, M, C which denote the respective colors at the ends thereof are used. Additionally, in the accompanying drawings, an upstream side of the conveyance direction of the sheet P by the conveyance belt 11 is referred to as a front side and a downstream side which is opposite to the upstream side is referred to as a rear side. Left and right sides is determined when the color printer 1 is viewed from the front side.

(2) Configuration for Displacement of Developing Cartridges

Figure 4:
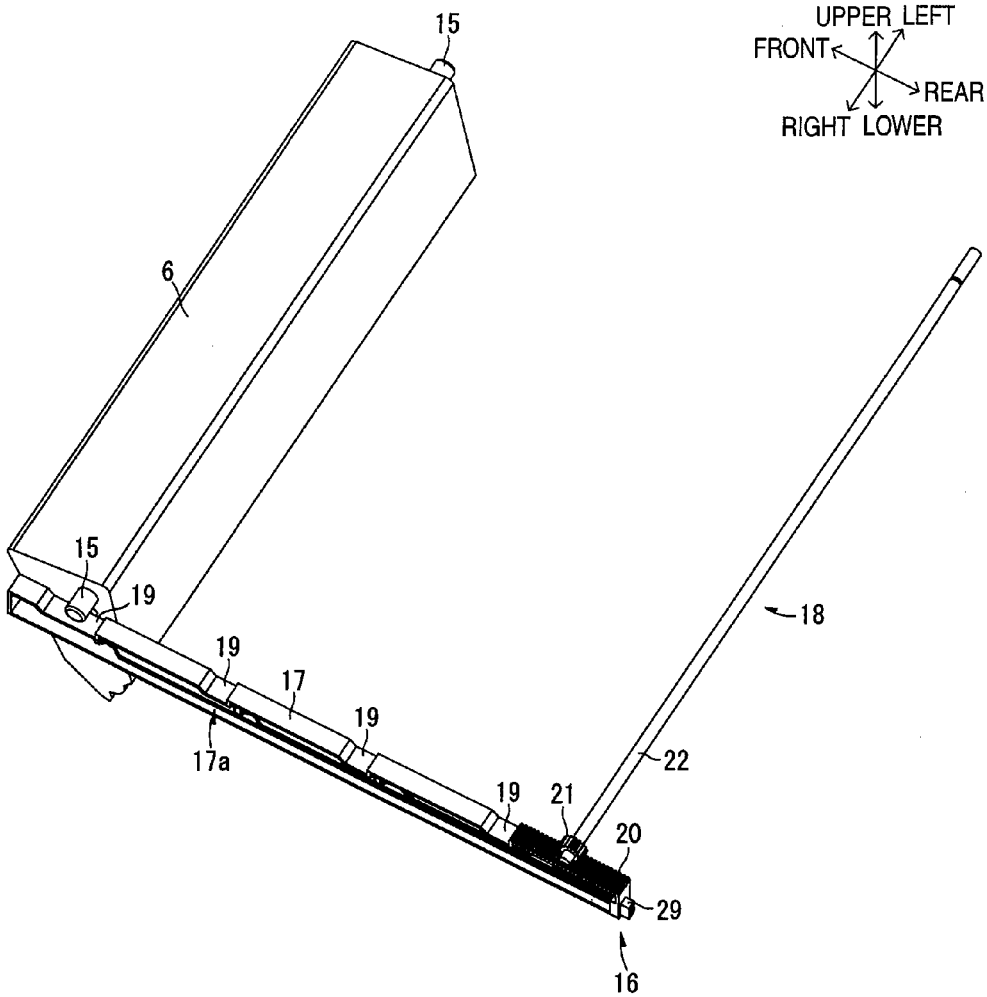
FIG. 4 is a perspective view of a displacement mechanism and the developing cartridge shown in FIG. 1.

FIG. 4 is a perspective view of the developing cartridge and a displacement mechanism.

The color printer 1 is capable of switching among an all contact state, a black contact state, and an all separated sate. In the all contact state, all the developing cartridges 6 are disposed in contact positions in which all the developing rollers 7 are in contact with the photosensitive drums 4. In the black contact state, the developing cartridge 6K for black is disposed in the contact position in which the developing roller 7 for the developing cartridge 6K is in contact with the photosensitive drum 4K while the developing cartridges 6Y, 6M, 6C for the other colors are disposed in separated position in which the developing rollers 7 of the those developing cartridges 6Y, 6M, 6C are separated from the photosensitive drums 4Y, 4M, 4C. In the all separated state, all the developing cartridges 6 are disposed in the separated positions, in which all the developing rollers 7 are separated from the photosensitive drums 4.

To realize this configuration, as shown in FIG. 4, cylindrical projections 15 which project leftwards and rightwards are respectively formed at upper portions of a left side surface and a right side surface of the housing 8 of each developing cartridge 6. In addition, the color printer 1 includes a displacement mechanism 16 for displacing the developing cartridges 6 between the contact positions and the separated positions.

The displace mechanism 16 includes a pair of left and right translation members 17 and a synchronous moving mechanism 18 for moving the pair of translation members 17 along a straight line in synchronism with each other.

The pair of translation members 17 have a symmetrical configuration in a left-right direction. Each translation member 17 has an external shape of substantially quadrangular rod which extends in a front-rear direction. Specifically, each translation member 17 has a U-shape which is opened outside in the right-left direction to have a space 17*a* in an interior thereof. In other words, the left side of the left translation member 17 is opened, and the right side of the right translation member 17 is opened. Each translation member 17 opposes the housings 8 of the four developing cartridges 6 from one side thereof and opposes the projections 15 formed on the four housings 8 from below. Additionally, each translation member 17 is held by a holder (not shown) provided in the body casing 2 movably in the front-rear direction.

Four recessed portions 19 are formed at equal intervals on an upper surface of the translation member 17 correspondingly to the developing cartridges 6. The frontmost recessed portion 19, that is, the recessed portion 19 which corresponds to the black developing cartridge 6K is formed longer in the front-rear direction than the three other recessed portions 19. Additionally, a rack gear 20 is formed at a rear end portion of the upper surface of the translation member 17.

The synchronous moving mechanism 18 includes pinion gears 21 which mesh respectively with the rack gears 20 on the left and right translation members 17 and a connecting shaft 22 to which the left and right pinion gears are attached so as not to rotate relatively.

In the drawings, the right translation member 17 and pinion gear 21 are shown, and the left translation member 17 and pinion gear 21 are omitted.

For example, an input gear (not shown) to which a driving force of a motor is inputted is made to mesh with the rack gear 20 on the left translation member 17. When the input gear is rotated in one direction by the driving force from the motor, the rotational force in the one direction is inputted into the rack gear 20, whereby the left translation member 17 moves forwards. As the left translation member 17 moves forwards, the left pinion gear 21 rotates, and the rotation of the left pinion gear 21 is transmitted to the right pinion gear 21 via the connecting shaft 22, whereby the right pinion gear 21 rotates in the same direction and by the same rotating amount as the left pinion gear 21. Then, the right translation member 17 moves forwards, that is, in the same direction and by the same moving amount as the left translation member 17. On the other hand, when the input gear is rotated in the other direction by the driving force of the motor, the rotational force in the other direction is inputted to the rack gear 20, whereby the left translation member 17 is moves rearwards. As the left translation member 17 moves rearwards, the left pinion gear 21 rotates, and the rotation of the left pinion gear 21 is transmitted to the right pinion gear 21 via the connecting shaft 22, whereby the right pinion gear 21 rotates in the same direction and by the same rotating amount as the left pinion gear 21. Then, the right translation member 17 moves rearwards or in the same direction and by the same moving amount as the left translation member 17.

As shown in FIG. 1, when the translation member 17 is disposed in the frontmost position, the respective projections 15 on the four developing cartridges 6 enter the recessed portions 19. In this state, the all contact state is achieved in which all the developing cartridges 6 are disposed in the contact positions, and all the developing rollers 7 are in contact with the corresponding photosensitive drums 4. In this all contact state, toner images of the corresponding colors can be formed on the surfaces of all the photosensitive drums 4, and by the toner images of the respective colors being transferred onto the sheet P in an overlapping manner, a full color image can be formed on the sheet P.

When the translation member 17 is moved rearward by a predetermined distance from the state shown in FIG. 1, while the projection 15 of the black developing cartridge 6K kept staying in the recessed portion 19, the projections 15 on the three other developing cartridges 6Y, 6M, 6C are dislocated from the recessed portions 19 and rest in other positions than the recessed portions 19 on the upper surface of the translation member 17 as shown in FIG. 2. By this operation, the black contact state is achieved in which only the black developing cartridge 6K is disposed in the contact position while the other color developing cartridges 6Y, 6M, 6C are lifted up to the separated positions. In the black contact state, a toner image can be formed only on the black photosensitive drum 4K, and a monochrome image can be formed on the sheet P by the black toner image being transferred onto the sheet P.

As shown in FIG. 3, when the translation member 17 is further moved rearward from the state shown in FIG. 2 and disposed in a rearmost position, the respective projections 15 of the four developing cartridges 6 are dislocated from the recessed portions 19 and rest in positions other than the recessed portions 19 on the upper surface of the translation member 17. By this operation, the all separated state is achieved in which all the developing cartridges 6 are disposed in the separated positions and all the developing rollers 7 are separated from the corresponding photosensitive drums 4. Since the all separated state is provided during a time period when no image is formed on the sheet P, the wasteful wear of the developing rollers 7 can be prevented.

(3) Memory Chips

In the color printer 1, as shown in FIGS. 1 to 3, a memory chip 23 for storing information on the developing cartridge 6 in a readable and writable manner is provided on the right surface of the housing 8 of each developing cartridge 6 at a position below the projection 15. As shown in FIGS. 2 and 3, two memory side contacts 24 are provided on a surface of each memory chip 23.

Herein, as information stored in the memory chips 23 before the color printer 1 is shipped from the factory, the specifications (toner capacity and the like) of the developing cartridges 6, ID codes intrinsic to the developing cartridges 6 and the like are conceivable as examples. On the other hand, as information that is written into the memory chips 23 during using the color printer 1, a consumed amount or a residual amount of toner, the number of times of image forming operations (the number of prints) executed by the use of the developing cartridges 6 and the like are conceivable as examples.

(4) Body Side Contacts

Figure 5:
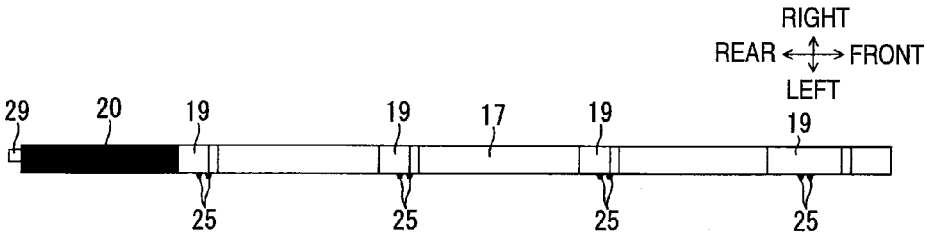
FIG. 5 is a plan view of a translation member shown in FIG. 4.
Figure 6:
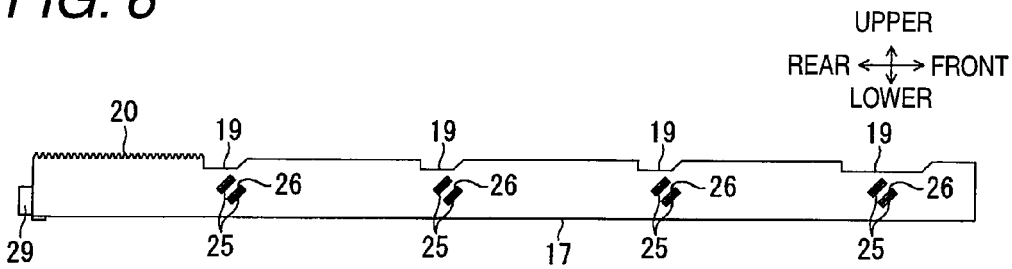
FIG. 6 is a left side view of the translation member shown in FIG. 4.
Figure 7:
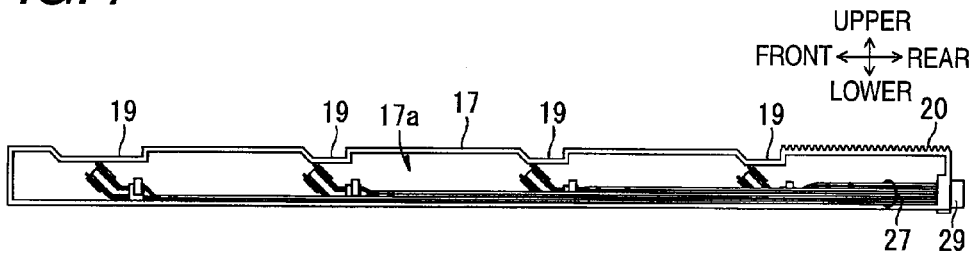
FIG. 7 is a right side view of the translation member shown in FIG. 4.
Figure 8:
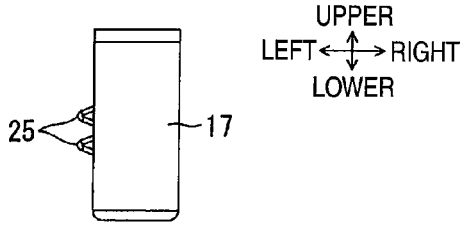
FIG. 8 is a front elevational view of the translation member shown in FIG. 4.
Figure 9:
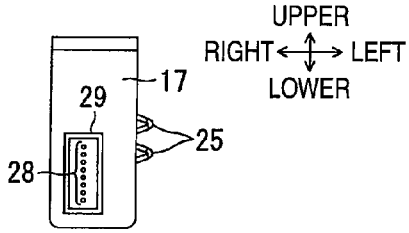
FIG. 9 is a back view of the translation member shown in FIG. 4.

FIG. 5 is a plan view of the translation member 17. FIG. 6 is a left side view of a right side of the right translation member 17, and FIG. 7 is a right side view of the right translation member 17. FIG. 8 is a front elevational view (a front view) of the right translation member 17. FIG. 9 is a back view (a rear view) of the right translation member 17.

The color printer 1 includes, as an example of a contact, eight body side contacts 25 in total correspondingly to the memory side contacts 24 which are provided on the four memory chips 23. The eight body side contacts 25 are disposed on a left surface of the right translation member 17 to project leftwards therefrom.

Specifically, as shown in FIG. 6, rectangular through holes 26, which are slightly elongated obliquely upwards and forwards, are formed in a left wall of the right translation member 17 in positions which oppose the respective memory side contacts 24 in the all contact state. The body side contacts 25 are each made up of a wire which is bent into a V shape. Additionally, as shown in FIGS. 6, 8 and 9, the body side contacts 25 are disposed so that the bent portions project leftwards from the left wall of the right translation member 17 through the through holes 26.

A wiring 27 is connected to each body side contact 25. The wirings 27 may be a wiring harness made up of electric wires which are covered with an insulation cover material or may be configured by wires integrally with the body side contacts 25. As is shown in FIG. 7, eight wirings 27 in total are disposed in the interior space 17*a* of the right translation member 17 so as to extend rearwards within the space 17*a*. As shown in FIG.

9, a connector 29 having eight terminals 28 is disposed on a rear wall of the translation member 17. A connector (not shown) provided at leading ends of wirings which extend from a reader/writer (not shown) for reading and writing information from and to the memory chips 23 is connected to the connector 29. The wirings 27 are connected to the terminals 28.

One of the wirings 27 which are connected to the two body side contacts 25 which correspond to each memory chip 23 is for transmitting and receiving voltage signals (0 to 5V) between the memory chip 23 and the reader/writer, and the other is for ground (0V) connection.

A capacitor (not shown) for generating an operation voltage is provided in a circuit incorporated in each memory chip 23. An on-state voltage signal (5V) is inputted into the memory chip 23 from the reader/writer during a period of time when no communication (reading and writing of information with respect to the memory chip 23) is carried out between the memory chip 23 and the reader/writer. In the memory chip 23, electric charges are accumulated in the capacitor using the voltage signal, whereby the voltage so accumulated in the capacitor is used as an operation voltage. Accordingly, the necessity of a wiring for supplying the operation voltage to each memory chip 23 can be obviated, thereby making it possible to simplify the configuration for implementing a communication with the memory chip 23.

According to the above-described configuration, in the all contact state shown in FIG. 1, the body side contacts 25 are in contact with the memory side contacts 24, whereby the memory chips 23 and the reader/writer are electrically connected to each other. Since a control unit (not shown) for controlling the respective units and components and including the reader/writer grasps in which one of the all contact state, the black contact state and the all separated state the color printer 1 is, the reading and writing of information with respect to the memory chips 23 can be performed by the control unit controlling the reader/writer when the color printer 1 is in the all contact state.

2. Advantages of the Exemplary Embodiment

As described above, the color printer 1 includes the four photosensitive drums 4 which are arranged in parallel with each other and aligned in the front-rear direction. Each photosensitive drum 4 includes the developing cartridge 6 which has the developing roller 7 and the casing 8 which holds the developing roller 7. The developing roller 7 can supply toner to the photosensitive drum 4 in a state in which the developing roller 7 is in contact with the photosensitive drum 4. The translation members 17 are provided on the sides of the developing cartridges 6 so as to oppose all the developing cartridges 6 at the same time. The translation members 17 are configured to reciprocate along a straight line in the front-rear direction. With this linear reciprocating movement of the translation members 17, the developing cartridges 6 are moved between the contact position in which the developing rollers 7 are in contact with the photosensitive drums 4 and the separated position in which the developing rollers 7 are separated from the photosensitive drums 4. The memory chips 23 are disposed on the housings 8 of the developing cartridges 6 at the portions which oppose the translation member 17. The body side contacts 25 which are in contact with the memory chips 23 and the wirings 27 connected to the body side contacts 25 are provided on the translation member 17. With this configuration, a space for arranging the body side contacts 25 and the wrings 27 while avoiding the translation member 17 is not required. As a result, an increase in size of the color printer 1 can be avoided which would otherwise be the case due to the arranging the body side contacts 25 and the associated wirings 27.

In order to achieve the contact between the body side contacts 25 and the memory chips 23 when the developing cartridges 6 are disposed both in the contact positions and the separated positions, the body side contacts 25 have to be disposed both in a first position where the body side contacts 25 oppose the memory chips 23 while the developing cartridges 6 are moved to the separated positions, and a second position where the body side contacts 25 oppose the memory chips 23 while the developing cartridges 6 are moved to the contact positions, or the body side contacts 25 have to be provided to extend to be situated both in the first position and the second position. This configuration requires an increase in the number of body side contacts 25 or a complex configuration of the body side contact 25.

In the color printer 1, when the developing cartridges 6 are moved to the contact positions, the contact of the body side contacts 25 with the memory chips 23 can be attained. In this configuration, neither the increase in the number of body side contacts 25 nor the complex configuration of the body side contact 25 is not required. Moreover, since the communication with the memory chips 23 can be implemented in such a state that the developing cartridges 6 are disposed in the contact positions and toner is supplied from the developing rollers 7 to the photosensitive drums 4, information such as a consumed amount or residual amount of toner can be written into the memory chips in real time.

In addition, the translation member 17 has the space 17*a*, and the wirings 27 are accommodated in this space 17*a*. According to this configuration, the wirings 27 do not interfere with the reciprocating straight-line movement of the translation member 17. As a result, the translation member 17 is allowed to reciprocate in a straight line smoothly, thereby making it possible to move the developing cartridges 6 between the contact positions and the separated positions smoothly.

In addition, the two body side contacts 25 are provided for each memory chip 23, and the two wirings 27 are electrically connected to the memory chip 23 via the body side contacts 25 so provided. In this way, even in the configuration in which the plurality of body side contacts 25 and wirings 27 are provided for each memory chip 23, since the space for disposing the body side contacts 25 and the associated wirings 27 is not required, an increase in size of the color printer 1 can be avoided.

Moreover, the two wrings 27 which are electrically connected to each memory chip 23 are the wiring for signal transmission and reception and the wiring for ground connection, and the operating voltage for the memory chip 23 is generated in the circuit incorporated in the memory chip 23. Consequently, the necessity of a wiring for supplying the operation voltage to the memory chip 23 can be obviated, thereby making it possible to simplify the configuration for communication with the memory chips 23.

3. Modified Examples

While the present invention has been shown and described with reference to certain exemplary embodiments thereof, it will be understood by those skilled in the art that various changes in form and details may be made therein without departing from the spirit and scope of the invention as defined by the appended claims.

For example, a configuration may be adopted in which the body side contacts 25 are disposed in positions where they oppose the memory side contacts 24 when in the all separated state, and in the all separated state, the body side contacts 25 are brought into contact with the corresponding memory side contacts 24, whereby the reading and writing of information with respect to the memory chips 23 can be attained.

Further, in the above-described exemplary embodiment, the body side contacts 25 protrude from the translation member 17. However, the present invention is not limited thereto. The body side contacts 25 may not protrude from the translation member. In this case, the memory side contacts protrudes toward the translation member 17.

The present invention is not limited to the tandem-type color printer 1. The inventive concept of the present invention can be applied to an intermediate transfer type color printer.

What is claimed is:

1. An image forming apparatus comprising:

a plurality of photosensitive members which are arranged in parallel with each other and aligned in a first direction;

a plurality of developing units which are provided correspondingly to the photosensitive members, respectively, and which arranged in parallel with each other and aligned in the first direction, each of the developing units comprising, a developer supplier configured to supply developer to the corresponding photosensitive member, and a housing which holds the developer supplier;

a translation member which opposes all the developing units from a side thereof in a second direction orthogonal to the first direction, and which moves the developing units between a contact position in which each of the developer suppliers contacts the corresponding photosensitive member and a separated position in which each of the developer suppliers is separated from the corresponding photosensitive member by a linear reciprocating movement of the translation member in the first direction;

a plurality of memory chips provided on the housings of the developing units, respectively, at portions which oppose the translation member;

a plurality of contacts provided on the translation member correspondingly to the plurality of memory chips, each of the contacts configured to contact the corresponding memory chips; and a wiring provided on the translation member and electrically connected to each of the contacts, wherein the contacts are disposed at positions opposing the corresponding memory chips, respectively, when the developing units are moved to the contact position.

2. The image forming apparatus according to claim 1, wherein the translation member includes a space for accommodating the wiring.

3. The image forming apparatus according to claim 1, wherein a plurality of contacts are provided for each of the memory chips, and wherein a plurality of wirings are electrically connected to each of the memory chips via the plurality of contacts.

4. The image forming apparatus according to claim 1, wherein each of the contacts provided on the translation member protrudes in the second direction from the translation member.

5. The image forming apparatus according to claim 1, wherein the wiring is provided on a first side of the translation member, which is opposite to a second side opposing the developing units.

6. The image forming apparatus according to claim 1, wherein each of the memory chips stores information on the corresponding developing unit.

7. An image forming apparatus comprising:

a plurality of photosensitive members which are arranged in parallel with each other and aligned in a first direction;

a plurality of developing units which are provided correspondingly to the photosensitive members, respectively, and which arranged in parallel with each other and aligned in the first direction, each of the developing units comprising, a developer supplier configured to supply developer to the corresponding photosensitive member, and a housing which holds the developer supplier;

a translation member which opposes all the developing units from a side thereof in a second direction orthogonal to the first direction, and which moves the developing units between a contact position in which each of the developer suppliers contacts the corresponding photosensitive member and a separated position in which each of the developer suppliers is separated from the corresponding photosensitive member by a linear reciprocating movement of the translation member in the first direction;

a plurality of memory chips provided on the housings of the developing units, respectively, at portions which oppose the translation member;

a plurality of contacts provided on the translation member correspondingly to the plurality of memory chips, each of the contacts configured to contact the corresponding memory chips; and a wiring provided on the translation member and electrically connected to each of the contacts, wherein a plurality of contacts are provided for each of the memory chips, wherein a plurality of wirings are electrically connected to each of the memory chips via the plurality of contacts, wherein two contacts are provided for each of the memory chips, and wherein a wiring for signal transmission and reception is electrically connected to each of the memory chips via one of the two contacts, and a wiring for ground connection is electrically connected to the memory chip via the other one of the two contacts.

8. An image forming apparatus comprising:

a plurality of photosensitive members which are arranged in parallel with each other and aligned in a first direction;

a plurality of developing units which are provided correspondingly to the photosensitive members, respectively, and which arranged in parallel with each other and aligned in the first direction, each of the developing units comprising, a developer supplier configured to supply developer to the corresponding photosensitive member, and a housing which holds the developer supplier;

a translation member which opposes all the developing units from a side thereof in a second direction orthogonal to the first direction, and which moves the developing units between a contact position in which each of the developer suppliers contacts the corresponding photosensitive member and a separated position in which each of the developer suppliers is separated from the corresponding photosensitive member by a linear reciprocating movement of the translation member in the first direction;

a plurality of memory chips provided on the housings of the developing units, respectively, at portions which oppose the translation member;

a plurality of contacts provided on the translation member correspondingly to the plurality of memory chips, each of the contacts configured to contact the corresponding memory chips; and a wiring provided on the translation member and electrically connected to each of the contacts, wherein the wiring is provided on a first side of the translation member, which is opposite to a second side opposing the developing units, wherein the translation member is formed with a plurality of holes, and wherein each of the contacts provided on the translation member protrudes to the second side from the first side through the corresponding hole.

* * * * *